United States Patent [19]

Day

[11] Patent Number: 4,869,087

[45] Date of Patent: Sep. 26, 1989

[54] DOOR SECURITY BRACKET

[75] Inventor: Robert L. Day, Sun Valley, Calif.

[73] Assignee: Sabir Locks, Inc., Pacoima, Calif.

[21] Appl. No.: 194,109

[22] Filed: May 16, 1988

[51] Int. Cl.[4] ..... E05B 63/00

[52] U.S. Cl. ..... 70/417; 70/418; 70/450; 70/452

[58] Field of Search ..... 70/450, 417, 418, 452; 292/346

[56] References Cited

U.S. PATENT DOCUMENTS

| | | | |
|---|---|---|---|
| 185,689 | 12/1876 | Mix | 70/450 |
| 3,377,094 | 4/1968 | Thompson | 292/346 |
| 4,041,741 | 8/1977 | Cintron | 70/417 |
| 4,673,204 | 6/1987 | Allenbaugh | 292/346 |

*Primary Examiner*—Robert L. Wolfe
*Attorney, Agent, or Firm*—Fred Flam

[57] ABSTRACT

A security device for a door structure comprises a simple bracket that surrounds the retractable latch element at the edge of the door, the bracket having a return extending along the inside of the door, stopping short of the inside latch or lock actuator. A resilient pad is interposed between the return and the door. The bracket is connected to the latch element, either directly or indirectly upon imposition of a break in force so that, immediately upon imposition of a kick force adjacent the lock, the latch element engages the bracket, thus transmitting the force to the inside return, and through the shock absorber to the inside part of the edge frame member.

1 Claim, 2 Drawing Sheets

Fig. 1.
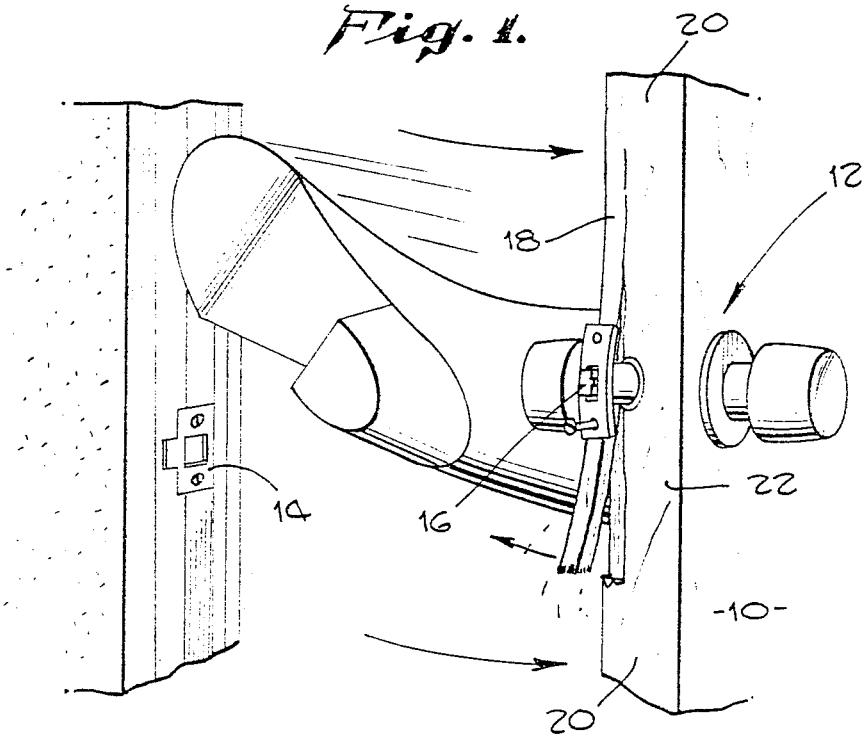
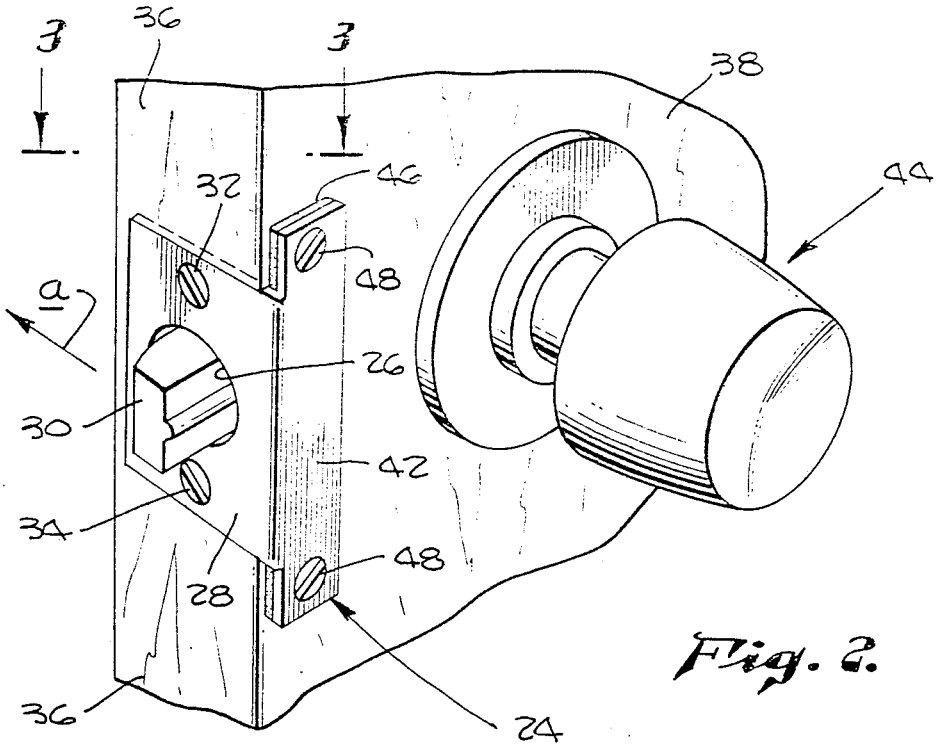
Fig. 2.

DOOR SECURITY BRACKET

FIELD OF THE INVENTION

This invention relates to security devices, and more particularly to devices for increasing the fracture resistance of a door thus to prevent or inhibit unauthorized entry.

BACKGROUND OF THE INVENTION

Rarely are entry doors made of solid, strong materials. Often they have partially hollow or particle board cores, reinforced more or less by interior ribs or stiles. Commonly, edge and interior frame members are enveloped between thin sheets of material. Door latches, door locks and bolts are commonly fitted into the edge frame member on the side of the door opposite the hinges. This edge frame member is easily broken by a sharp kick planted not on the lock or latch, but just next to it; as a result of the sharply imposed force, the lock, kept in place by the companion parts on the door jamb, tears the adjacent outer part of the edge frame member from the main body of the door, allowing the broken door to swing inwardly. Only the outer half of the edge frame member breaks away because the latch or lock is mortised in the middle of the edge frame member.

One known prior art security device utilizes a large metal channel that slips over the edge of the door inwardly beyond the door knobs or door levers, the channel having holes for passage of the knobs or levers. A manufacturer of one such device states that the purposes are (1) to encase the lock; (2) to prevent the lock from being torn out of the door; and (3) to make the door as strong as the lock. It is believed, however, that the channel operates effectively for the reason that in order for rupture to occur, the inner half of the edge frame member must now break away along with the outer half of the edge frame member, the connecting portion of the channel tying these two frame parts together. While effective, the channel structure is quite bulky and unsightly. Installation requires the door latch or lock parts to be removed and reattached.

The object of the present invention is to make a vastly improved and unobtrusive security device in the form of a strap or bracket that, without in any way affecting the latch or lock actuators, ties the inner half of the edge door frame member to the outer half of the edge door frame member at the region of the lock or latch, thus greatly increasing the ability of the door to resist rupture.

Another object of the present invention is to provide a device of this character in which a shock absorber is interposed between the door and the edge frame mebmer thereby to dissipate the thrust of the kick.

SUMMARY OF THE INVENTION

In order to accomplish the foregoing objectives, I provide a simple bracket that surrounds the retractable latch element at the edge of the door, the bracket having a return extending along the inside of the door, stopping short of the inside latch or lock actuator. The bracket is fastened, as by screws, both at the edge of the door and at the inside of the door. A resilient pad is interposed between the return and the door. The bracket stops the latch bolt assembly from breaking out the outer half of the edge frame member. For this purpose the bracket is coupled to the latch bolt assembly so that, immediately upon imposition of a kick force adjacent the lock, the latch element engages the bracket, thus transmitting the force to the inside return, thence through the shock absorber and finally to the inside part of the edge frame member; thus the latch element and lock cannot be torn away from the door without rupturing both the inside and outside of the edge frame element. At the same time, the kick thrust is dissipated by the resilient pad.

This invention possesses many other advantages, and has other objects which may be made more clearly apparent from a consideration of the embodiments of the invention shown and described.

BRIEF DESCRIPTION OF THE DRAWINGS

A detailed description of the invention will be made with reference to the accompanying drawings wherein like numerals designate corresponding parts in the several figures. These drawings are to scale.

FIG. 1 is pictorial view illustrating how a sharp kick imposed adjacent a conventional unprotected lock structure breaks the door open without rupturing the inner half of the edge frame member.

FIG. 2 is a pictorial view showing a bracket and pad installed at a typical latch set.

DETAILED DESCRIPTION OF THE PREFERRED EMBODIMENT

Figure 3:
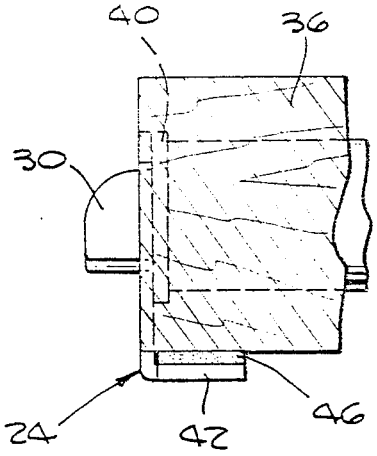
FIG. 3 is a fragmentary sectional view taken along a plane corresponding to line 3—3 of FIG. 2.
Figure 4:
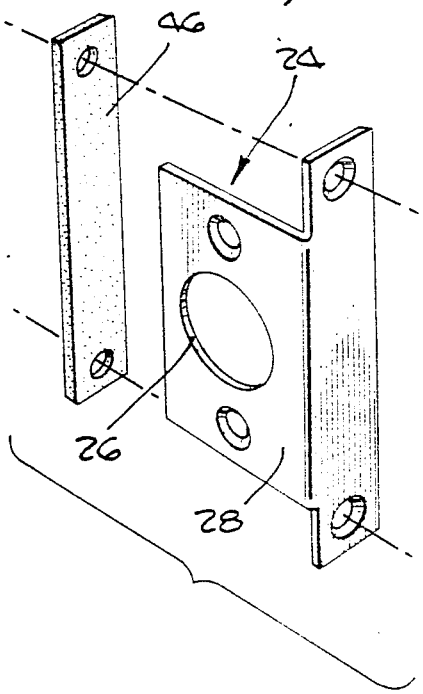
FIG. 4 is an exploded pictorial view showing the bracket and pad components of the bracket structure of FIG. 1.

The following detailed description is of the best presently contemplated mode of carrying out the invention. This description is not to be taken in a limiting sense, but is made merely for purposes of illustrating the general principles of the invention, the scope of the invention being defined by the appended claims.

Structural and operational characteristics attributed to the form of the invention first described shall also be attributed to another form described hereinafter, unless such characteristics are obviously inapplicable or unless specific exceptions are made.

FIG. 1 illustrates how a typical door 10 is broken open by a sharp kick applied from the outside of the door just above the lock or latch structure 12. As the kick is applied, the strike plate 14 restrains the bolt 16, causing it to tear out the outer part 18 of the edge frame element 20. The door is broken in without rupturing the inner part 22 of the edge frame element.

In order to prevent this simple rupture by a kick so placed, a bracket 24 (FIG. 2) made of metal or other strong material is provided. It has an opening or hole 26 in its face plate 28 that slips over the projecting latch bolt 30. The edges of the opening have clearance relative to the bolt 30 to avoid interference therewith during normal operation. Screws 32 and 34 attach the face plate to the edge frame member 36 of the door 38. In the present example, the screws pass through the two holes of a latch plate 40 (FIG. 3) that forms with the latch bolt 30 a part of a latch subassembly. The bracket 24 may be mortised in the edge of the door.

The bracket 24 has a right angled return 42 that extends inwardly from the door edge along the inner face of the door. It stops well short of the latch actuator 44.

A shock absorbing pad 46 made of resilient material, such as neoprene, is interposed between the return and the inside door face. Screws 48 attach the return to the door. The pad 46 accommodates the bracket to standard doors despite slight deviations from nominal thickness. More importantly, the pad serves an energy absorbing function to be hereinafter described.

Should a sharp kick be applied to the door 38 with the bracket attached, the restrained latch bolt 30 will not fracture at the outer part of the edge frame member 36 alone. Thus the latch bolt assemblyis restrained by the bracket 24, the screws 32 and 34 acting in shear resisting the tendency of the bolt 30 and its assemlbyto break out in the direction of the arrow a. Force in this instance is transmitted primarily throughthe latch bolt 30, the latch bolt assembly, the latch plate 40, the screws 32 and 34 to the bracket 24, the return 42, the pad 46 to the inside part of the edge frame member 36. Accordingly, before the latch bolt and its subassembly can break out of the door, the entire edge frame member 36 at the region of the latch bolt 30 must be ruptured. The integrity of the door is vastly increased. The resisting force may also be transmitted through the edge of the bracket opening 26 to the latch bolt 30 if the slight clearance between the opening 26 and latch bolt 30 is taken up under load conditions, which may occur. This mode of force transmission will the primary mode in those instances in which the latch does not include an appropriate latch bolt plate as part of a latch subassembly.

The pad 46, in addition to serving as a means for taking up tolerances for installation purposes, also absorbs a significant amount of the energy applied, thus dissipating the impact. An exceedingly heavy kick force will be required to break the door. No part of the bracket is visible from the outside of the door; hence an unauthorized person is not made aware of the fact that an extraordinary force might be required to fracture the door. The attempt at unauthorized entry will very likely be thwarted.

The bracket 24 can be applied by the simplest of tools; it is unnecessary to detach any part of the door latch in order to install the bracket.

DESCRIPTION OF SECOND EMBODIMENT

Figure 5:
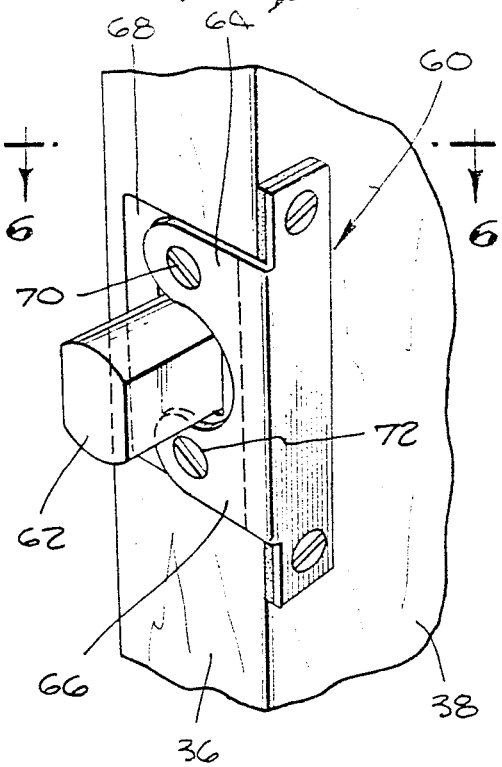
FIGS. 5 and 6 are views similar to FIGS. 2 and 3, but showing another embodiment of the present invention.
Figure 6:
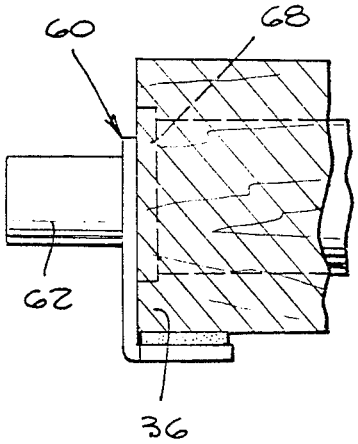

In FIG. 5, a bracket 60 is shown installed about a dead bolt 62. In this example, the bracket plate has bifurcations 64 and 66 that extend above and below the bolt 62 for connection to the dead bolt plate 68. In the present instance, only the screws 70 and 72 that fasten the bracket 60 to the plate 68 serve as a means for transmitting breakout force to the inside of the door. The distance between the mounting holes for latch plates is essentially standard, whereas the cross sectional configurations of latches and bolts is not. Thus the bracket 60, having no hole surrounding the bolt is capable of substantially universal application.

The apparatus has been tested in accordance with the Uniform Building Security Code, Chapter 41, Section 41,1005 using the specified door ram. A particle board door 1.75" thick with standard rails and stiles, a $\frac{1}{8}$" plywood skin fitted with a standard cylinder deadbolt lock was tested. The door successfully resisted, without discernible failure anywhere, the impact of a 160 pound ram released at a distance of 54 inches from the door face.

Intending to claim all novel, useful and unobvious features and combination of features shown and/or described, I claim:

1. In a door structure having an edge frame member and a lock mechanism including a retractable bolt and a bolt plate as well as actuating means for projecting and retracting the bolt, said bolt plate having at least two screw holes for fastening the bolt subassembly to an edge of a door, the combination therewith of:

(a) a bracket having a face plate abutting the edge frame member at the edge of the door, said face plate having screw holes aligned with the screw holes of said bolt plate;

(b) screws extending through the aligned holes and fastening both the bracket and said bolt subassembly to said door;

(c) said bracket having a return extending along the edge frame member at the inside of the door, and terminating short of said actuating means;

(d) no part of said bracket extending to the outside of the door whereby the presence of said bracket cannot be detected;

(e) means fastening said return to the inside of said door; and (f) a shock absorbing resilient pad interposed between said return and said door for dissipating a shock load imposed upon said retractable bolt by exertion of a force at the outside of the door.

* * * * *